US006123333A

United States Patent [19]

McGinnis, Sr. et al.

[11] Patent Number: 6,123,333

[45] Date of Patent: Sep. 26, 2000

[54] METHOD OF PLAYING A WAGERING GAME

[76] Inventors: Richard G. McGinnis, Sr., 203 S. 3rd St., Lewisberg, Pa. 17837; Richard G. McGinnis, Jr., 117 W. 58th St., New York, N.Y. 10019; Adam Politzer, 14 Stone Creek La., Bryn Mawr, Pa. 19010; Charles McGinnis, 203 S. 3rd St., Lewisberg, Pa. 17837

[21] Appl. No.: 09/042,772

[22] Filed: Mar. 17, 1998

Related U.S. Application Data

[60] Provisional application No. 60/040,981, Mar. 17, 1997, and provisional application No. 60/040,861, Mar. 18, 1997.

[51] Int. Cl.[7] ..... A63F 9/24

[52] U.S. Cl. ..... 273/146; 463/22

[58] Field of Search ..... 463/13, 20, 22, 463/21, 31, 37; 273/268, 146, 269, 138.1, 139, 306

[56] References Cited

U.S. PATENT DOCUMENTS

| | | | |
|---|---|---|---|
| Re. 34,244 | 5/1993 | Hagiwara | 273/138 A |
| 3,208,754 | 9/1965 | Sieve | 273/146 |
| 3,865,368 | 2/1975 | Grazebrook | 273/1 E |
| 4,506,890 | 3/1985 | Murry | 273/138 A |
| 5,033,744 | 7/1991 | Bridgeman et al. | 273/85 CP |
| 5,108,099 | 4/1992 | Smyth | 273/138 A |
| 5,125,660 | 6/1992 | Stahl | 273/146 |
| 5,145,175 | 9/1992 | Gathman et al. | 273/146 |
| 5,224,708 | 7/1993 | Gathman et al. | 273/146 |
| 5,249,805 | 10/1993 | Neil et al. | 273/237 |
| 5,308,065 | 5/1994 | Bridgeman et al. | 273/85 CP |
| 5,356,140 | 10/1994 | Dabrowski et al. | 273/85 |
| 5,393,057 | 2/1995 | Marnell, II | 273/85 CP |
| 5,395,111 | 3/1995 | Inoue | 273/143 R |
| 5,524,898 | 6/1996 | Pavlovic | 273/292 |
| 5,704,835 | 1/1998 | Dietz, II | 463/20 |
| 5,997,401 | 12/1999 | Crawford | 463/20 |

OTHER PUBLICATIONS

U.S. application No. 09/042,770, filed Mar. 17, 1998, entitled "Method of Playing a Wagering Games" (McGinnis, Sr. et al).

*Primary Examiner*—Valencia Martin-Wallace
*Assistant Examiner*—John Paradiso
*Attorney, Agent, or Firm*—Synnestvedt & Lechner LLP

[57] ABSTRACT

A method of playing a wagering game against a house which includes the steps of wagering an amount of credits, randomly selecting and displaying at least two symbols, and making a payout based on the payout value for the combination of symbols selected. The symbols selected are from a finite set of multi-dimensional symbols which have at least two values. Each value is from a distinct dimension having at least two distinct values wherein all values within a dimension are equally probable.

30 Claims, 7 Drawing Sheets

METHOD OF PLAYING A WAGERING GAME

CROSS-REFERENCE TO RELATED APPLICATION

This application claims the benefit of U.S. Provisional Application 60/040,981 filed Mar. 17, 1997, and U.S. Provisional Application 60/040,861 filed Mar. 18, 1997.

BACKGROUND OF THE INVENTION

1. Field of the Invention

The present invention relates to games and more particularly to games used for gambling.

2. Description of Related Art

There are many wagering games used for gambling. Such games should be exciting to arouse players' interest and uncomplicated so that they can be understood easily by a large number of players. Ideally, the games should include multiple opportunities for player skill during the course of the game, yet be able to be played rapidly to wager-resolving outcomes. Exciting play also provides the player with frequent small pay-outs and the opportunity for large jackpot wins.

Wagering games, particularly those intended primarily for play in casinos, should provide players with a sense of participation and control, and the opportunity to make decisions. They should also provide reasonable odds of winning even though odds favor the house, i.e., the gambler's expected return for each unit of currency gambled is less than 1 unit. A casino will never act as a bank for a game in which the average player has the advantage over the house. The game must also meet the requirements of regulatory agencies.

Many casino games use a standard deck of cards. A standard deck of playing cards contains a 4×13 set of symbols, that is four card suit values (spade, heart, diamond, club) by 13 card rank values (2, 3, 4, 5, 6, 7, 8, 9, 10, J, Q, K, A). The standard deck represents a complete set of multi-dimensional symbols, that is, all 52 possible symbol combinations of the suits and ranks are represented. Some popular casino games that use a standard deck of playing cards or a video representation of a standard deck of playing cards are Blackjack, Baccarat, CARIBBEAN STUD POKER®, LET IT RIDE® and Video Poker. In each of these games, cards are drawn from one or multiple decks of cards without replacement. If the six of hearts is the first card drawn, it is less likely that the following card will also be a six of hearts.

Many other casino games use multiple six-sided dice to determine pay outs. When multiple dice are rolled, the outcome of each die is independent of the other dice. As a result, symbols selected by rolling dice are chosen with replacement. The set of symbols used by standard dice, however, has only one dimension—the set of numbers one to six. Some popular casino games that use dice are Craps and Sic-Bo.

The Roulette Wheel is another device used to generate symbols in a casino environment. Each time a symbol is selected from a roulette wheel it is selected from the entire set of symbols. As a result each spin of the roulette wheel is said in probability terms to be independent of all other spins, and symbols are chosen with replacement. Although each symbol from a roulette wheel is marked by two attributes (values), a color and a number, it is not a complete set of multi-dimensional symbols. It is possible to select a red three, but it is impossible to select a black three.

Many different types of slot machines exist that use many different sets of symbols. For example, U.S. Pat. No. 5,395,111 discloses a slot machine in which each symbol is selected by rotating a set of two independent wheels—an inner wheel rotating within an outer wheel. The outer wheel displays card suits, the inner wheel displays rank values from 2 to 10 and "J", "Q", "K", and "A". A complete symbol is formed by combining the randomly selected symbol from both wheels, e.g. Jack of Clubs. Multiple sets of inner and outer wheels provide a full hand of symbols each play. This game, however, does not teach that each set of independent wheels represents a complete set of symbols, or that each symbol is chosen with replacement.

Another game device that allows players another set of symbols is TIBBITs brand dice disclosed in U.S. Pat. Nos. 5,145,175 and 5,224,708 (both owned by TIBBITs International, Inc.). These patents disclose 12-sided dice with a 4×3 matrix (e.g., four card suits by three card values) and twenty-sided dice with 4×5 matrix (e.g., four card suits by five card values). However, there are no games using these dice which give the house a positive expectation and which are suitable for casino gambling.

Accordingly, it is an object of the present invention to provide wagering games having integrity of chance and total randomness.

Another object is to provide a method of play where the house can control the expectation of winning over the long term.

A further object of the invention is to provide a game where the pay-out values can be changed to alter the expectation of the house.

Another object of the invention is to provide a method of game playing that is easily adapted to physical or electronic video play.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the methods and combinations particularly pointed out in the appended claims.

SUMMARY OF THE INVENTION

The present invention provides a new method of playing a wagering game against a "house". Broadly, the method includes the step of wagering an amount of credits and then randomly selecting and displaying at least two symbols to form a hand. One possible embodiment rolls a particular type of dice to randomly select and display the symbols. The various possible combinations of symbols in a hand are assigned pay-out values. The pay-out values are determined so that the house has a desired expectation of return or winning in the long run. The pay-out to the player is based on the pay-out value for the hand randomly selected.

The symbols randomly selected and displayed are taken from a complete set of multi-dimensional symbols with replacement. Multi-dimensional means each symbol is made of two or more dimensions. Each symbol is marked by a value of the first dimension combined with a value for each additional dimension. For example, each card from a standard 52 card deck of playing cards contains a symbol made by combining values from two dimensions—one value from the dimension which includes the four suits (Hearts, Spades, Diamonds and Clubs) and a value from the second dimension which includes the 13 rank values (2 to 10, J, Q, K and A), for a total combination or complete set of 52 possible symbols. The present invention requires that all possible symbols of the complete set be equally probable for random selection and display. Moreover, each random selection must be made with replacement, that is, the selection of one symbol does not affect the outcome of subsequent selection of symbols.

BRIEF DESCRIPTION OF THE DRAWINGS

These and other features, aspects, and advantages of the present invention will become better understood with reference to the following description, appended claims, and accompanying drawings where:

DETAILED DESCRIPTION OF THE INVENTION

The present invention provides a new and novel method of playing a wagering game against a house. Described below are several embodiments of the invention particularly suited for wagering games played in a casino where the house is the Casino, Bank, dealer, etc. It is understood, however, that the present invention can be adapted to other types of games involving wagering.

Figure 1:
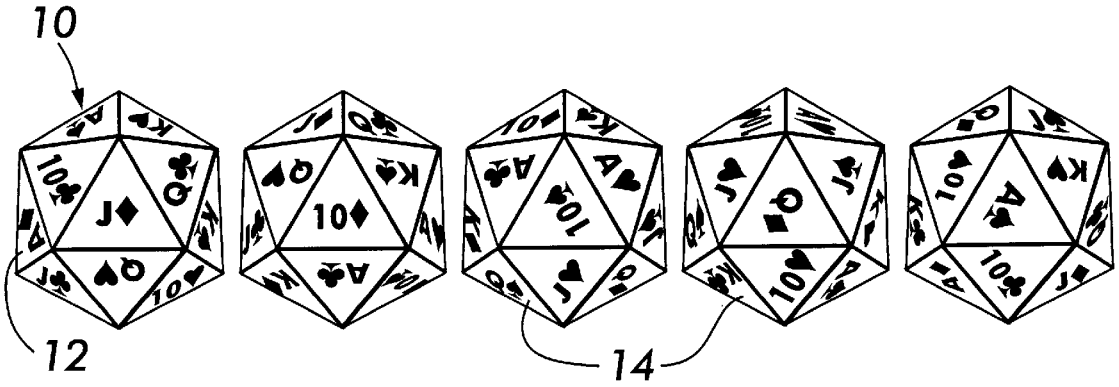
FIG. 1 is a perspective view of five twenty-sided dice used for playing one embodiment of the invention.

Reference is now made to an embodiment of the invention which uses five twenty-sided dice as shown in FIG. 1. Such dice, marketed under the trademark TIBBITS®, are fully disclosed in U.S. Pat. No. 5,145,175 which is hereby incorporated by reference.

As an initial step, the present game requires the wagering of an amount of credits. A player bets an amount of money, tokens, tickets or other form of credit which is acceptable to the house.

The game continues with the random selection and display of at least two symbols to form a hand. In the present embodiment, five symbols are selected and displayed by rolling the five dice 10 shown in FIG. 1. The particular face 12 on the top of each rolled die displays the symbol selected.

Each die 10 provides a finite set of multi-dimensional symbols 14 which have an equal probability of selection. The complete set of symbols 14 appearing on each twenty-sided die 10 is shown below in Table 1.

TABLE 1

| | | | |
|---|---|---|---|
| A♠ | A♥ | A♣ | A♦ |
| K♠ | K♥ | K♣ | K♦ |
| Q♠ | Q♥ | Q♣ | Q♦ |
| J♠ | J♥ | J♣ | J♦ |
| 10♠ | 10♥ | 10♣ | 10♦ |

Multi-dimensional means each symbol 14 has two or more distinct dimensions. Each symbol is marked by a value of one dimension combined with a value for each additional dimension. Each value in each dimension is distinct in that it appears only once in that dimension. Further, all values within a dimension are equally probable and as a result all symbols are equally probable. A complete set means a set having all possible symbols i.e., all combinations of values.

In the illustrated embodiment, each die 10 has twenty faces 12 which are marked with the playing card symbols 14 having a two dimensional matrix. One dimension consists of four suit values (spades, hearts, clubs and diamonds) and the other dimension consists of five rank values (A, K, Q, J and 10). This 4×5 two dimensional matrix of symbols provides a finite set of twenty probable symbols. As each of the twenty probable symbols appears on only one of the twenty faces, each die contains a complete set of the twenty symbols. Each value in each dimension is equally probable within the dimension, i.e., each suit value is equally probable within the dimension having four suits and each rank value is equally probable within the dimension having five rank values. All symbols of the complete set are equally probable of being selected with each roll of the die.

It is further seen that each symbol is always selected with replacement. Replacement means that with each roll, each randomly selected symbol is always selected from the full set of symbols on the die. Thus the outcome of one roll of a die has absolutely no effect on the outcome of other or subsequent symbols selected. Dice inherently select symbols with replacement since all possible symbols remain on each die for each new roll. A card dealt from a deck of cards, however, must always be dealt from a full deck of cards to be done with replacement.

After the five symbols are selected and displayed to form a hand, the pay-out, if any, is made to the player. The pay-out is based on the particular combination of the displayed symbols. Pay-out values for each unit of credit wagered are predetermined and assigned for each possible combination of five symbols. The pay-out values are chosen to provide the desired expectation of winnings to the house over the life of the game. The house expectation can be defined with the following formulas:

HouseExpect:Long-run expectation of the house $PlayerTotExpLoss_i$:$Player_i$'s total expected loss $PlayerExpLoss_i$:$Player_i$'s expected loss per game $NumGames_i$:Number of games played by $Player_i$ $Win_i$:$Player_i$'s average winning per game $Bet_i$:$Player_i$'s average bet per game $$PlayerExpLoss_i = Bet_i \times (1.0 - (Win_i / Bet_i))$$

$$PlayerTotExpLoss_i = PlayerExpLoss_i \times NumGames_i$$

$$HouseExpect = \Sigma_i (PlayerTotExpLoss)_i$$

A numerical example with three players:

| $Player_1$ | $Bet_1$ | $Win_1$ | $NumGames_1$ | $PlayerExpLoss_1$ | $PlayerTotExpLoss_1$ |
|---|---|---|---|---|---|
| 1 | 1.00 | 0.90 | 100 | 1.00 × (1.0 − (.90/1.00)) = 0.10 | 0.10 × 100 = 10.00 |
| 2 | 1.00 | 1.01 | 200 | 1.00 × (1.0 − (1.01/1.00)) = −.01 | −.01 × 200 = −2.0 |
| 3 | 1.00 | 0.94 | 300 | 1.00 × (1.0 − (.94/1.00)) = 0.06 | 0.06 × 300 = 18.00 |

HouseExpect=10.00−2.00+18.00=26.00

A positive expectation for the house would guarantee the house makes money over the long term. A schedule of pay-out values calculated to give the house an expectation greater than zero (positive) is shown in Table 2 below.

TABLE 2

| | PAY-OUT TABLE | | |
|---|---|---|---|
| | One Suit | Two Suits | Three + Suits |
| Five of a Kind | | | |
| Aces High | 1200 | 24 | 12 |
| Faces High | 600 | 18 | 9 |
| Tens High | 60 | 12 | 6 |
| Four of a Kind | | | |
| Aces High | 60 | 12 | 6 |
| Faces High | 30 | 6 | 3 |
| Full House | | | |
| Aces High | 30 | 6 | 3 |
| Faces High | 10 | 2 | 1 |
| Three of a Kind | | | |
| Aces High | 10 | 2 | 1 |

The left column of Table 2 refers to the number of particular "kinds" (rank) of cards, i.e., A, K, Q, J, and 10. For example, "Five of a Kind—Aces High" means five Aces; "Five of a Kind—Faces High" means five of the same face (K, Q or J). "Full House" means three of a kind and two of a kind. Thus, "Full House—Aces High" means three Aces and two of any other kind; "Full House—Faces High" means three of any same face, and two of any other kind.

The top row of Table 2 refers to the total number of suits. This number of suits is independent of the combination of particular "Kinds" of cards in hand. "One Suit" means all five symbols of the hand are of the same Suit; "Two Suits" means all five are of two suits; "Three+" means the five symbols displayed are of three or more suits.

The pay-out values of Table 2 are based on the numbers of "a kind" as well as the numbers of the same suit in a given hand. For example, a hand of A♦, A♦, A♦, A♦, A♦ constitutes "Five of a Kind—Aces High—One Suit" for a pay-out of 1200 units for each unit of credit wagered. If money is being wagered, a $1 bet would return $1200 (amount of wager×the pay-out value). A hand having 10♥, 10♥, 10♥, 10♦, 10♦ constitutes "Five of a Kind—Tens High—Two Suits" for a pay-out of $12 for every $1 wagered; a hand of J♥, J♥, J♥, J♦, 10♦ constitutes "Four of a Kind—Faces High—Two Suits" for a pay-out of $6 for every $1 wagered; a hand of A♥, A♥, A♥, J♥, J♥ constitutes a "Full House—Aces High—One Suit" for a pay-out of $30 for every $1 wagered; a hand of A♦, A♦, A♥, 10♠, 10♠ constitutes a "Full House—Aces High—Three+Suits" for a pay-out of $3 for every $1 wager; a hand of A♦, A♦, A♦, J♦, 10♦ constitutes "Three of a Kind—Aces High—One Suit" for a pay-out of $10 for every $1 wagered; a hand of A♥, A♥, A♥, J♦, 10♠ constitutes "Three of a Kind—Aces High—Three+Suits" for a return of $1 for every $1 wagered. Any combination other than those represented in Table 2 have a pay-out value of 0 i.e., no payout is made to the player.

Table 2 is just one example of potential pay-out values that can be assigned to the different combinations of symbols in a hand. Any schedule of pay-out values can be used as long as the schedule provides the desired expectation to the house.

The payout of any winnings is typically made at the end of the game. If the hand does not contain a combination that has been assigned a payout value, no payout is made. If the hand has a "winning combination", i.e., a combination having a payout value, the player receives a payout based on the payout value and the amount wagered.

The game described above can be played at a table, a video terminal such as a slot machine or through any other suitable format. At a table, the symbols can be generated by means of physically rolling actual dice.

Figure 2:
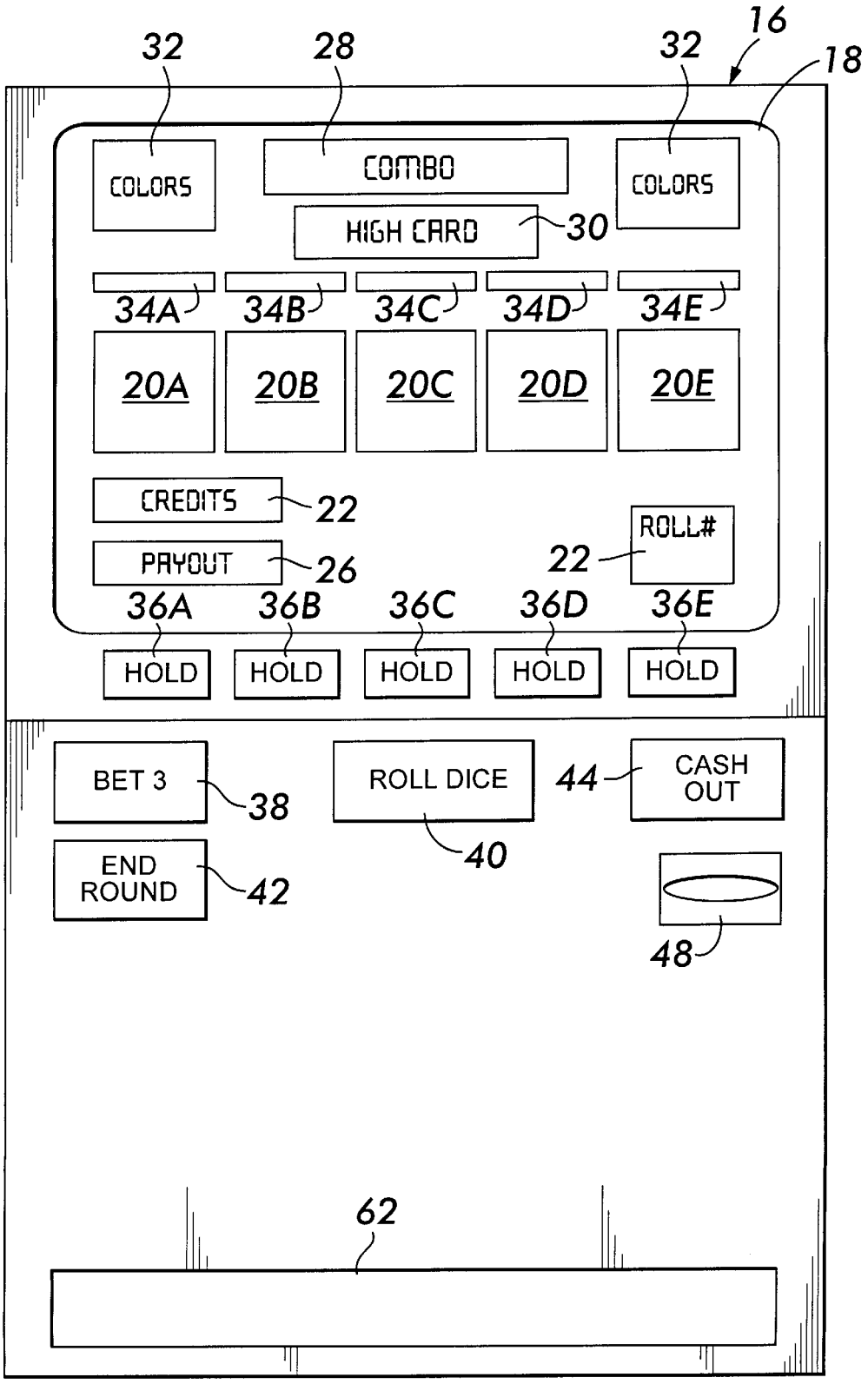
FIG. 2 is a schematic view of a video device for playing another embodiment of the present invention.

An embodiment of the present invention played with an electronic video device is now described with reference to FIGS. 1, 2 and 3. Illustrated in FIG. 2 is an electronic device 16 for playing the present invention using video representations of the twenty-sided dice 10. A video display screen 18 displays the five dice 10 in screen windows 20A, 20B, 20C, 20D and 20E. The screen 18 has the potential to show any number of symbols required to play a game of the current invention. Displays on the screen show the number of credits the player has entered 22, the roll number of the current game 24, the pay-out of the current hand 26, the combination of the current hand 28, the card value or "High value" 30 of the combination, and the number of different Suits shown in the current hand 32. Additional hold displays 34A, 34B, 34C, 34D and 34E appear above the windows 20A, 20B, 20C, 20D, and 20E when a player indicates a desire to hold a particular die. Control buttons are provided on the machine to operate the following functions, hold die 36A, 36B, 36C, 36D and 36E, bet three 38, roll dice 40, end round 42, and cash out 44.

The game is played with video representations of five twenty-sided dice 10. The dice 10 contain symbols in a 4×5 matrix, that is four card suits by five rank values as described above. The four card suits are black Spades, red Hearts, green Clovers, and blue Diamonds. Here, each suit is displayed in a distinct color unlike in a deck of cards. Thus, the number of "red" cards is the same as the number of "Hearts". The five card rank values are 10 (Ten), J (Jack), Q (Queen), K (King) and A (Ace), it being understood that the letters e.g. "J", are synonymous with the ranks, e.g. "Jack".

Figure 3:
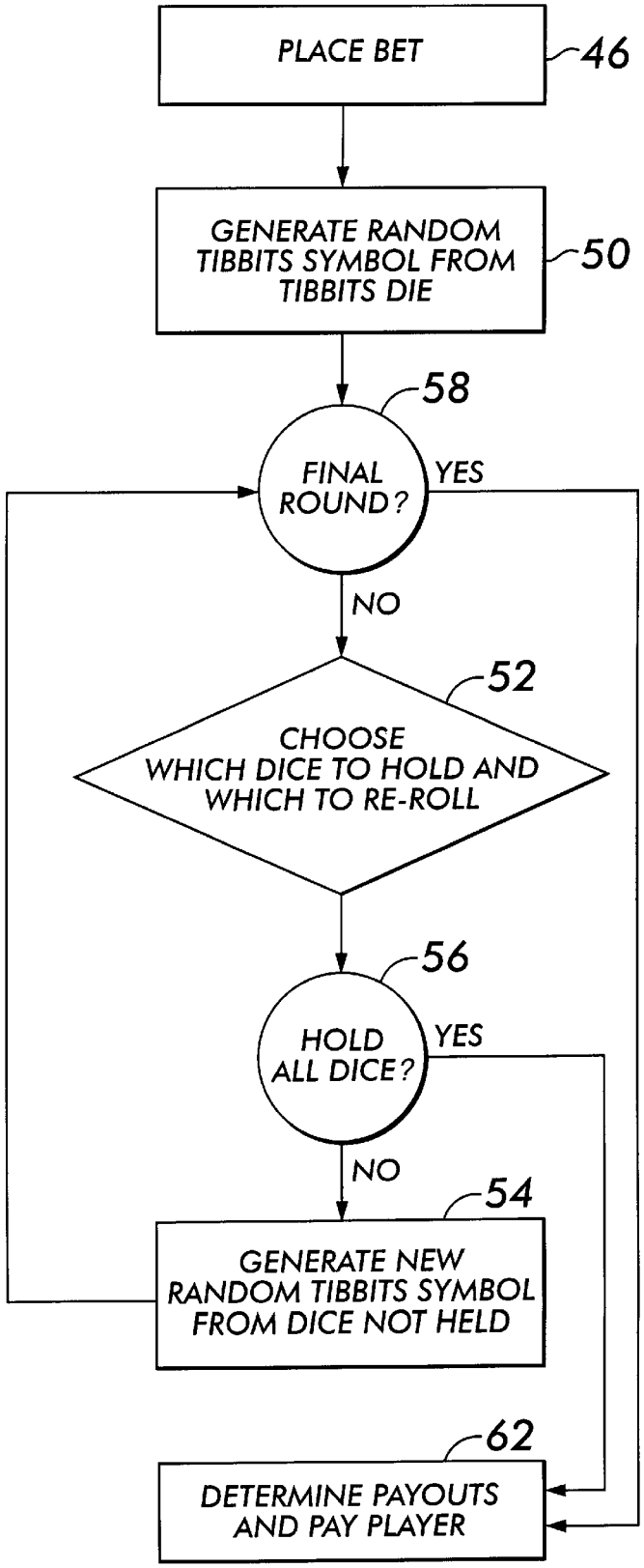
FIG. 3 is a flow diagram for the method of playing the embodiment of FIG. 2.

The game is initiated by wagering an amount of credits i.e., placing the bet (see box 46, FIG. 3). A player approaches the machine and must insert coins or tokens into the coin acceptor 48 or obtain credit from a credit card, debit card, or other means. Each coin or token inserted increases the credit display 22 by one. A player must have at least three credits in order to play this game. To begin play, the player activates the bet-three button 38, this button will subtract three credits from the credits display 22.

Once the game has started, the symbols are randomly selected and displayed (see box 50, FIG. 3). In this step, the player activates the roll button 40 and a randomly generated representation of a die 10 is displayed in each of the windows 20A, 20B, 20C, 20D, and 20E. Each of the representations will clearly show the symbol 14 of one die face 12 that has been rolled. It is important to note each of the twenty symbols 14 has an equal probability of occurring in each screen window 20A–20E. In addition to causing the dice images to appear, the roll button 40 will increase the roll number display 24 from 0 to 1.

The electronic device 16 is programmed to provide the set of multi-dimensional symbols associated with the twenty-sided die discussed herein. Those of ordinary skill recognize that electronic devices can be programmed to provide any multi-dimensional set and in any form, such as a deck of playing cards, or using any other type of symbols or values. It can also be readily programmed to make each selection with replacement.

In the present embodiment, the player may choose which of the displayed symbols to hold, and to randomly select and display new symbols to replace the symbols which were not held. The new symbols are also selected with replacement and thus any symbol, including the symbol the player wishes to replace, has the same probability of selection. In this step (box 52, FIG. 3), the player inspects the hand and chooses which dice to hold and which dice to re-roll. The player indicates the desire to hold a die by pressing the corresponding hold button 36A–36E. In addition, hold buttons activate the hold displays 34–34E of the dice to be held. For example, by pressing hold button 36C, a player holds the face 12 of the die 10 depicted in the window 20C and causes the hold display 34C to read "Hold". If a hold display reads "Hold" and the player presses the corresponding hold button again, the hold display will disappear indicating that the player wishes to re-roll the particular die. If all symbols are held, the game is ended and the wager resolved as described below (see FIG. 3, circle 56).

Once a player has made all decisions, the player presses the roll button 40 which will randomly generate and display new faces with symbols for the dice not held and increases the roll number display 24 by one (see FIG. 3, box 54). In this embodiment, a player is permitted to select which dice to hold and which dice to re-roll as long as the re-roll number display 24 is less than three. The third roll is final (see FIG. 3, circle 58). This game gives the player two opportunities to re-roll the dice to improve the hand.

Throughout the game, if a winning combination of dice is displayed in the windows 20–20E, the displays for combination 28, high value 30, number of suits 32, and pay-out 26 are activated. The combination display 28 shows the player what winning combination (i.e. five of a kind, four of a kind, full house, or three of a kind) is rolled; the high value display 30 shows the player what rank value (i.e., Ace, King, Queen, Jack, or Ten) occurred with the highest frequency; and the number of different suits 32 shows the player how many different suits or colors are represented in the hand (i.e., one, two, three, or four). The pay-out display 26 shows the player the potential payout of the current hand in terms of number of coins or tokens. This value is based on the combination rolled, including the high value, the number of different suits represented as shown in Table 2 above and the amount of the wager.

At any point during play, the player may press the end round button 42 to end the game (see FIG. 3, circle 58) and resolve the bets (see FIG. 3, box 60) by making the payout. The end round button 42 increases the value of the credits display 22 by the value of the pay-out display 26. At this point the game is over. If the Credits display 22 reads a number greater than three, the player can begin a new game by pressing the Bet Three Button 38. Otherwise the player must increase his credit usually by inserting more money into the coin in slot 48 in order to play again. Aside from starting the game again, the Bet Three Button 38 will also reset the images on the screen by turning off the images of dice and the hold displays from the previous game. In addition it will turn off the displays relating to winning combinations.

Between games, the player has the option to collect all credits. The activation of the cash out button 44 causes gaming tokens to be dispensed from a hopper inside the machine (not shown) into the tray 62. The number of coins dispensed into the tray will be equal to the value of the credits display 22 which will subsequently set itself to zero.

Other variations or modifications to the game will be apparent to those skilled in the art. For example, the present invention is not limited to a 4×5 two dimensional matrix of symbols. One possibility is a 3×2×2 matrix of symbols, having three dimensions, one dimension having three values, the second having two values, and the third two values, which would provide a complete set of twelve symbols. A twelve-sided die, or card deck of 12 cards would be needed to provide a complete set of symbols. An example of a twelve-sided die is shown in U.S. Pat. No. 5,145,175. Although it has a 4×3 two dimensional matrix of symbols, those of ordinary skill in the art recognize that it is easily adapted to a 3×2×2 three dimensional matrix. The following is an example of a possible set of dimensions which can be combined to provide a three-dimensional 3×2×2 set of symbols:

| | |
|---|---|
| Dimension One: | Number |
| Value One: | 1 |
| Value Two: | 2 |
| Value Three: | 3 |
| Dimension Two: | Shade |
| Value One: | Clear |
| Value Two: | Solid |
| Dimension Three: | Shape |
| Value One: | Circle |
| Value Two: | Square |

Other possibilities could use the 3×4 multi-dimensional matrix of symbols provided by twelve-sided dice disclosed in U.S. Pat. No. 5,145,175. The possible variation of multi-dimensional symbols is limitless.

Figure 4:
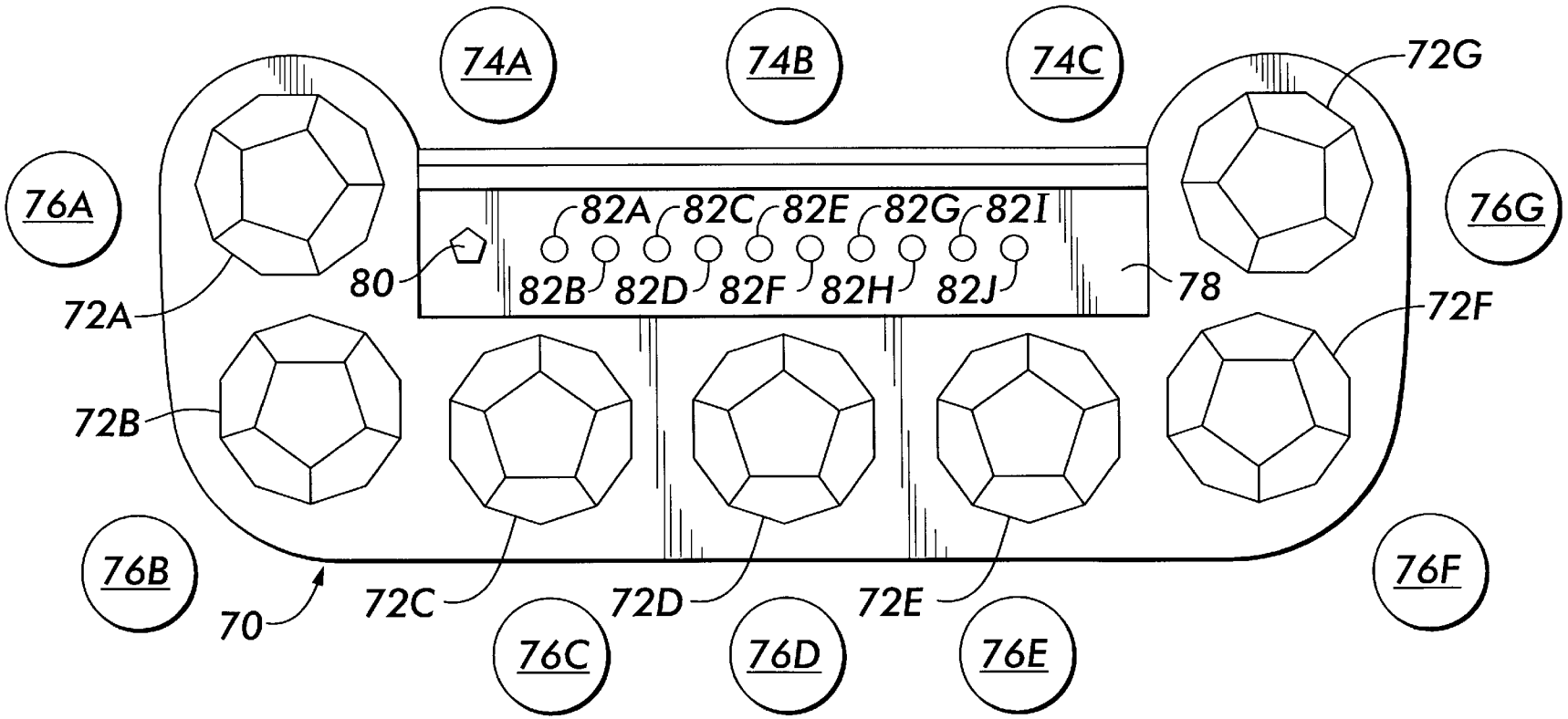
FIG. 4 is a top view of a table apparatus for playing another embodiment of the invention.
Figure 5:
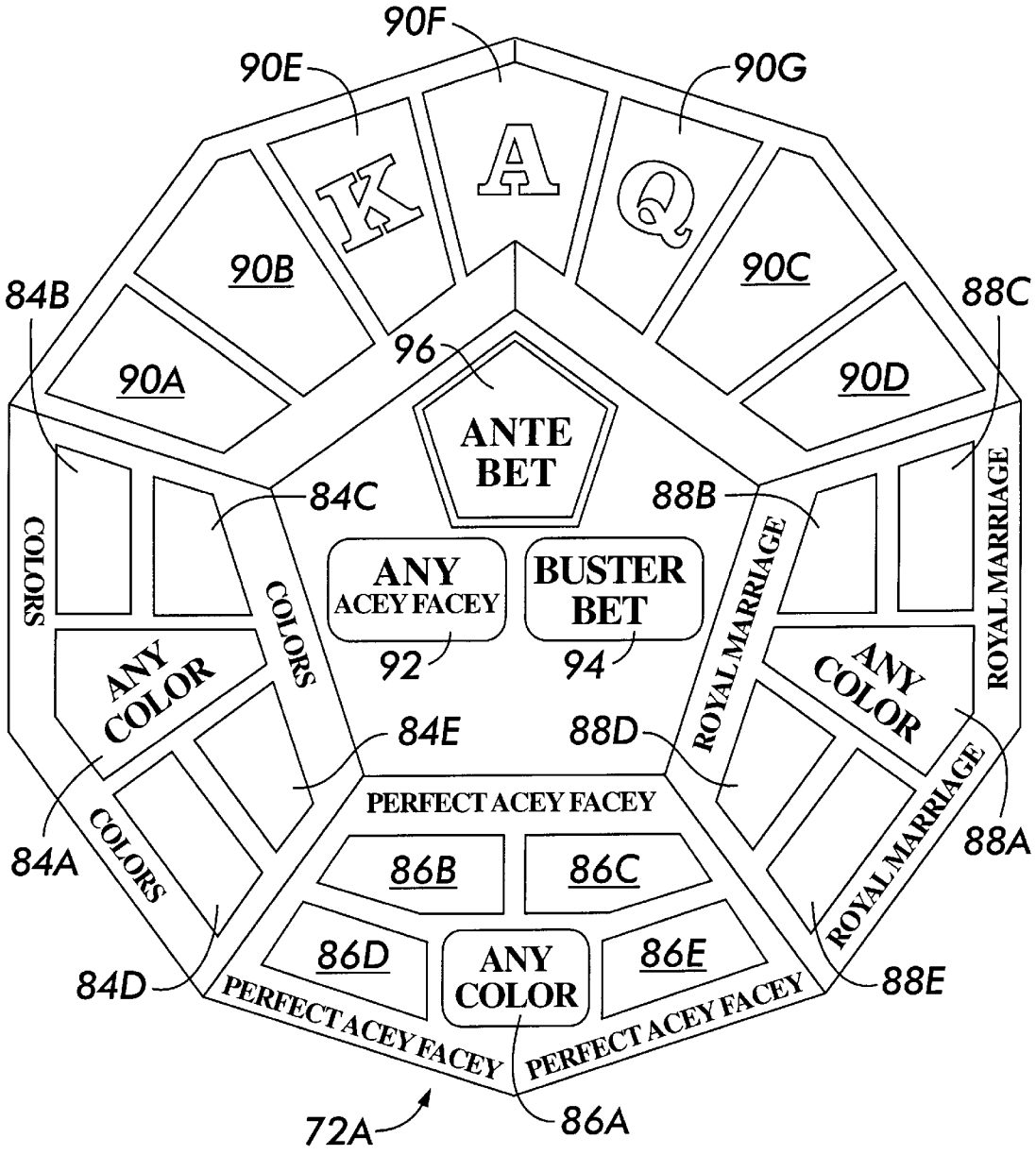
FIG. 5 is a close up view of the table apparatus of FIG. 4.

Another embodiment is described with reference to FIGS. 4 and 5. FIG. 4 shows a table apparatus 70 for playing ACEY FACEY and FIG. 5 shows a close up of an individual player betting board 72A. The table 70 contains three dealer seats 74A, 74B, and 74C, seven player seats 76A, 76B, 76C, 76D, 76E, 76F and 76G, a rolling pit 78, seven player betting boards 72A, 72B, 72C, 72E, 72F and 72G, an ACEY FACEY marker 80, and ten ACEY FACEY marker locations 82A–J. The board 70 designates different areas where a player may place a wager.

Seven players can play ACEY FACEY at a time at this apparatus. Each player takes a spot 76A, 76B, 76C, 76D, 76E, 76F or 76G in front of his or her own personal betting board 72A, 72B, 72C, 72D, 72E, 72F or 72G. A game begins with the marker 80 placed in position 82A while players are given a few moments to place bets. Players indicate a wager by placing chips into any of the wager areas on their betting board (72A–72G). Players may place as many wagers as they like. Here, the players are betting that the symbols or combination of symbols wagered on will be randomly selected and displayed as further discussed below.

After all bets have been placed, one of the players is designated as the shooter. The shooter rolls two twelve-sided dice as shown in FIG. 2 of U.S. Pat. No. 5,145,175 to randomly select and display two symbols. Each die has a complete set of symbols from a 3×4 two-dimensional matrix where one dimension consists of the rank values A, K, Q and the other dimension consists of the four suit values. The complete set of symbols is shown in Table 3:

TABLE 3

| | | | |
|---|---|---|---|
| A♠ | A♥ | A♣ | A♦ |
| K♠ | K♥ | K♣ | K♦ |
| Q♠ | Q♥ | Q♣ | Q♦ |

Each suit value is marked with a distinct color, e.g. all hearts are red, clovers green, diamonds blue and spades black. Thus a flush of all hearts is the same as a flush of all reds.

All bets other than the center bet are considered roll bets. Roll bets can be placed at any point during play and are resolved after each roll of the die. If a combination of symbols wagered upon is selected and displayed, a payout is made to the player that made the winning wager. The payout is based on the payout value for the combination of symbols which is predetermined to provide the desired expectation of return for the house. A listing of all of the different roll bet combinations, along with a description and their pay-out values are listed below in the Payout Table 4.

TABLE 4

Roll Bet Payout

| Wager | Location on board | Description | Pay-out |
|---|---|---|---|
| Colors - any color | 84A | Any same color | 2.5 |
| Colors - specific color | 84B-E | A same specific color | 10 |
| Perfect ACEY FACEY - any color | 86A | An Ace and King or Queen of any same color | 7 |
| Perfect ACEY FACEY -specific color | 86B-E | An Ace and a King or Queen of a same specific color | 28 |
| Royal Marriage - any color | 88A | A King and Queen of any same color | 15 |
| Royal Marriage - specific color | 88B-E | A King and Queen of a same specific color | 60 |
| Perfect Pair - specific color | 90A-D | Any same rank of a specific color | 40 |
| Perfect Pair - specific rank | 90E-G | A same specific rank of any same color | 30 |
| Perfect Pair | — | Any same rank of any same color | 10 |
| ACEY FACEY | 92 | An Ace and either a King or Queen | 1 |
| Buster | 94 | Neither colors ACEY FACEY, Perfect Pair or Royal Marriage | 1 |

For example, a wager for any color would bring a payout value of 2.5 upon the rolling of any two symbols of the same color or suit (since each suit is of a distinct color). A wager for a specific color would provide a payout value of 10 upon the rolling of two symbols of the same color or suit specified by the wager, e.g., a wager on the specific color green would require that both symbols be green while the rank can be any combination. A wager for a PERFECT ACEY FACEY of any color would have a payout value of 7 if the rolled dice randomly select an Ace rank on one die and a King or Queen rank on the other die with the color of the two symbols being the same. A PERFECT ACEY FACEY specific color has a payout value of 28 upon the rolling of an Ace rank on one die and a King or Queen rank on the other die and both symbols being of the same color as specified in the wager. A wager for a ROYAL MARRIAGE any color pays out upon the random selection of a King rank on one die and a Queen rank on the other die with the two symbols being of any same color. A ROYAL MARRIAGE specific color is similar except that the wager is for a King and a Queen of a specified color. A wager for a PERFECT PAIR—specific color pays out when the rolled dice show the same rank (any rank) of a specified color. A PERFECT PAIR—specific rank wager pays out upon the dice rolling a same specified rank and both being of any same unspecified color. A simple PERFECT PAIR requires the random rolling of any unspecified same rank and of any unspecified same color. An ACEY FACEY is the rolling of an Ace rank and a King or Queen rank on the other die, the particular color or suit being irrelevant. A BUSTER is anything other than a ROYAL MARRIAGE, PERFECT PAIR, ACEY FACEY, PERFECT ACEY FACEY or one of the color bets.

The payout values in Table 4 are preferably chosen to provide the house a positive expectation over the long term.

The center bet 96 can only be placed by a player when the ACEY FACEY Marker 80 is located in position 82A. The pay-out of the bet is determined by the number of a particular combination of symbols, here ACEY FACEYs (a roll where one die is an Ace and the other is a King or a Queen) rolled in a row by the shooter. After each ACEY FACEY, the dealer moves the ACEY FACEY marker 80 one position to the right as seen in FIG. 4. The bet is resolved only after either the tenth ACEY FACEY is rolled or after any roll other than an ACEY FACEY. After the bet is resolved the dealer moves the ACEY FACEY marker 80 back to the original position 82A, a new shooter is chosen and the game begins again. Players win the center bet 96 if either two or more ACEY FACEYs are rolled in a row or a Royal Marriage (King and queen of same color) is rolled while the marker 80 is in location 82A. The following Table 5 summarizes the pay-out for various numbers of ACEY FACEYs in a row.

TABLE 5

CENTER BET PAYOUT VALUE

| ROLL | EXAMPLE | DESCRIPTION | PAYOUT | OUTCOME |
|---|---|---|---|---|
| Stage One | | | | |
| 1 | A♥ | A♥ Perfect Pair | 1 to 1 | Round ends |
| 1 | K♦ | Q♦ Royal Marriage | 1 to 1 | Round ends |
| 1 | A♥ | K♣ ACEY FACEY | N/A | Go to Stage two |
| 1 | Q♦ | Q♥ Other | lose | Round ends |
| Stage Two | | | | |
| 2 | A♦ | K♣ ACEY FACEY | N/A | Go to Roll 3 |
| 2 | K♥ | Q♥ Other | lose | Round ends |
| 3 | A♦ | K♠ ACEY FACEY | N/A | Go to Roll 4 |
| 3 | K♠ | Q♦ Other | 1 | Round ends |
| 4 | A♣ | K♣ ACEY FACEY | N/A | Go to Roll 5 |
| 4 | K♦ | Q♥ Other | 2 | Round ends |
| 5 | A♦ | K♥ ACEY FACEY | N/A | Go to Roll 6 |
| 5 | K♦ | Q♣ Other | 3 | Round ends |
| 6 | A♠ | K♠ ACEY FACEY | N/A | Go to Roll 7 |
| 6 | K♦ | Q♦ Other | 4 | Round ends |
| 7 | A♠ | K♦ ACEY FACEY | N/A | Go to Roll 8 |
| 7 | K♥ | Q♦ Other | 5 | Round ends |
| 8 | A♥ | K♣ ACEY FACEY | N/A | Go to Roll 9 |
| 8 | K♥ | Q♣ Other | 10 | Round ends |
| 9 | A♠ | K♣ ACEY FACEY | N/A | Go to Roll 10 |
| 9 | K♦ | Q♥ Other | 25 | Round ends |
| 10 | A♥ | K♠ ACEY FACEY | N/A | Go to Roll 11 |
| 10 | K♦ | Q♥ Other | 100 | Round ends |
| 11 | A♦ | K♦ ACEY FACEY | 500 | Round ends |
| 11 | K♦ | Q♥ Other | 200 | Round ends |

The payout values are preferably chosen to provide the house a positive expectation over the long term.

Figure 6:
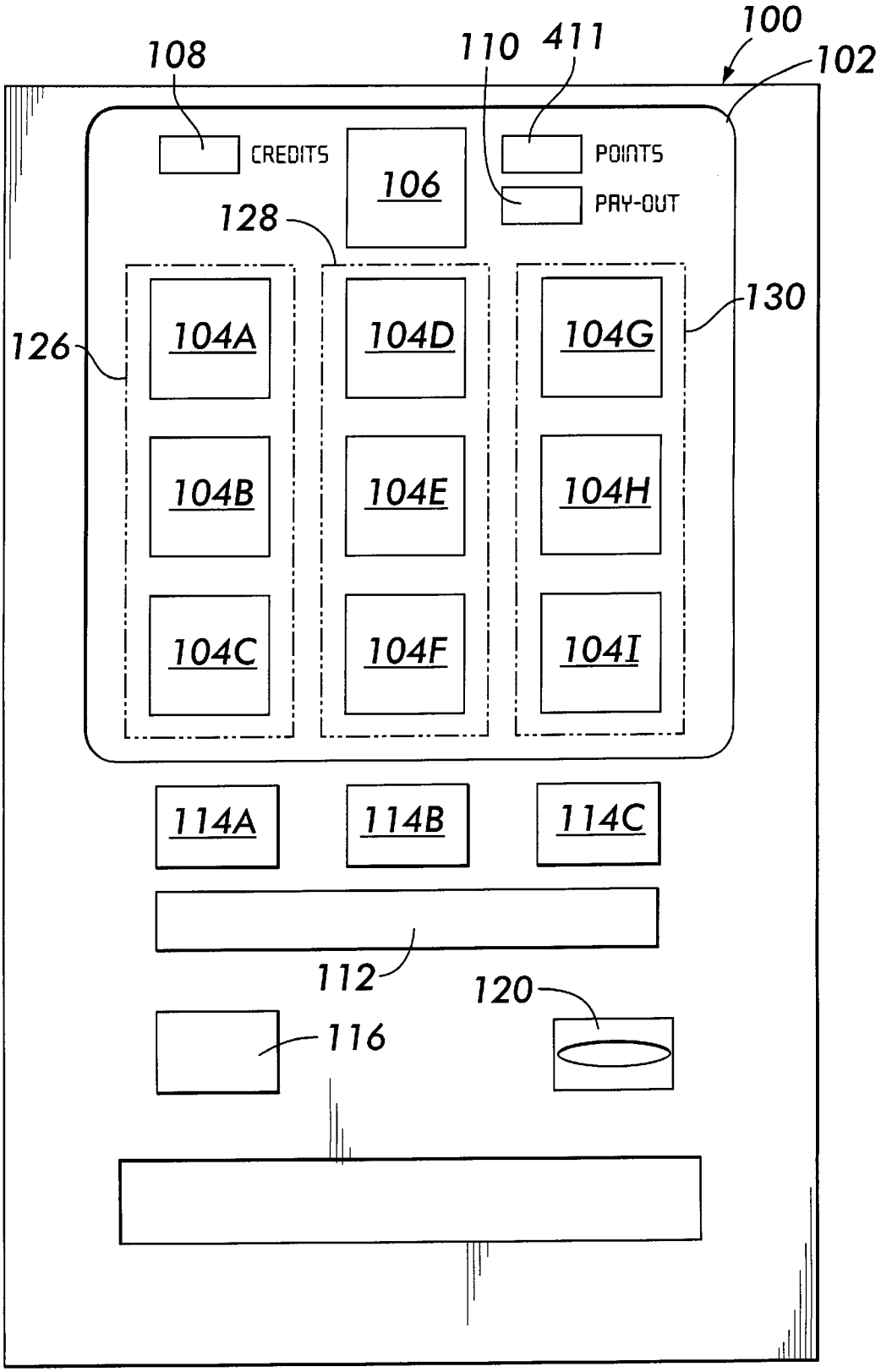
FIG. 6 is a schematic view of an electronics device for playing another embodiment of the invention.

Another embodiment of the invention is illustrated in FIG. 6 showing an electronic video device 100. The device is illustrated in connection with use for a game called MAGIC SCALE. A video display screen 102 shows screen window locations 104A, 104B, 104C, 104D, 104E, 104F, 104G, 104H, and 104I for displaying a representation of dice; and a top window location 106 for displaying a top die. Displays on the screen show how many credits the player has entered 108 and the pay-out of the current combination 110. Control buttons are provided to operate the following functions; bet three 112, place die 114A, 114B and 114C, and cash out 116.

A player initiates the game by making a wager. The player inserts coins or tokens into the coin acceptor 120 or obtains credit from a credit card, debit card, dollar bill, or other means acceptable to the house. Each coin or token inserted increases the credit display 108 by one. To make the wager, the player activates the bet button 112. The bet button 112 subtracts three credits from the credits display 108 provided the credit display 108 is at least three and the player is not in the middle of a game. Players must bet at least three credits to play MAGIC SCALE.

Once the bet button 112 has been activated, a randomly selected die 10 is generated and displayed in the top die window 106. The representation will clearly show one die face.

In this embodiment the dice generated are twenty-sided dice 10 of the type shown in FIG. 1. Each die 10 provides a finite and complete possible set of multi-dimensional symbols 14 having an equal probability of selection as previously shown in Table 1. Moreover, each selection of a symbol is provided with replacement.

Once the die face is shown in the top window 106, the player next chooses a playing set into which the symbol displayed in die window 106 is placed. In the present embodiment three playing sets are provided which are represented by columns—column 126 formed by windows 104A, 104B and 104C; column 128 formed by windows 104D, 104E and 104F; and column 130 formed by windows 104G, 104H and 104I. At least two playing sets are necessary, three sets being used in the present embodiment. The sets can be sized to hold a maximum desired number of symbols.

The choice of column is made by pressing one of the place buttons 114A, 114B, or 114C. Place button 114A indicates the left column 126; place button 114B indicates the center column 28; and place button 114C indicates the right column 130. The image of the die falls to the lowest available location of the selected column.

Once the die has been placed, the above steps are repeated. A new randomly generated representation of a die 10 appears in the top die window 106 which is placed into the column (set) chosen by the player. Play continues until all dice have been placed into the different board locations 104A to 104I. Players are not permitted to select a column that already contains three dice as this is the maximum number of symbols each set can hold in this embodiment. A minimum of three symbols in each set is necessary to form a complete hand in this embodiment.

Once a player has made all decisions, a final or tenth die 10 appears in the top die window 106 to complete the hand. The score is then tabulated. The score is the sum of six point values associated with the six different combinations of dice—a three dice combination in each of the three columns 126, 128, 130 and a four dice combination of the dice in each column 126, 128, 130 in combination with the top die in the window 106. The different three dice combinations are TIBSTER (all dice depicting the same exact face), straight flush (three consecutive ranks of same color, e.g. J, K, Q), three-of-a-kind (three of same rank regardless of color), flush (three of same color), and loss. The different four dice combinations are Grand Tibster (all dice depicting the same exact face), grand straight flush (four consecutive ranks of same color), four-of-a-kind (four of same rank), grand flush (four of same color) and loss.

The point values for the combinations are summarized in Table 6 below.

TABLE 6

POINT TABLE

| Three Dice Combination | Points | Four Dice Combination | Points |
|---|---|---|---|
| Tibster | A | Grand Tibster | E |
| Straight Flush | B | Grand Straight Flush | F |
| Three-of-a-Kind | C | Four-of-a-Kind | G |
| Flush | D | Grand Flush | H |
| Loss | 0 | Loss | 0 |

The pay values A to H are preferably set by the house to provide the desired expectation of winnings—they are points per each unit of wager which is 3 credits in this embodiment.

After the payout, if the credits display 108 is at least three, the player can begin a new game by activating the bet button to clear all dice images, reset the pay-out display 110 to zero, and adjust credit display 108 appropriately.

At any point, the player has the option to collect all credits. The activation of the cash out button causes gaming tokens to be dispensed from a hopper inside the machine (not shown) into the tray. The number of coins dispensed into the tray will be equal to the value of the credits display which will subsequently set itself to zero.

Figure 7:
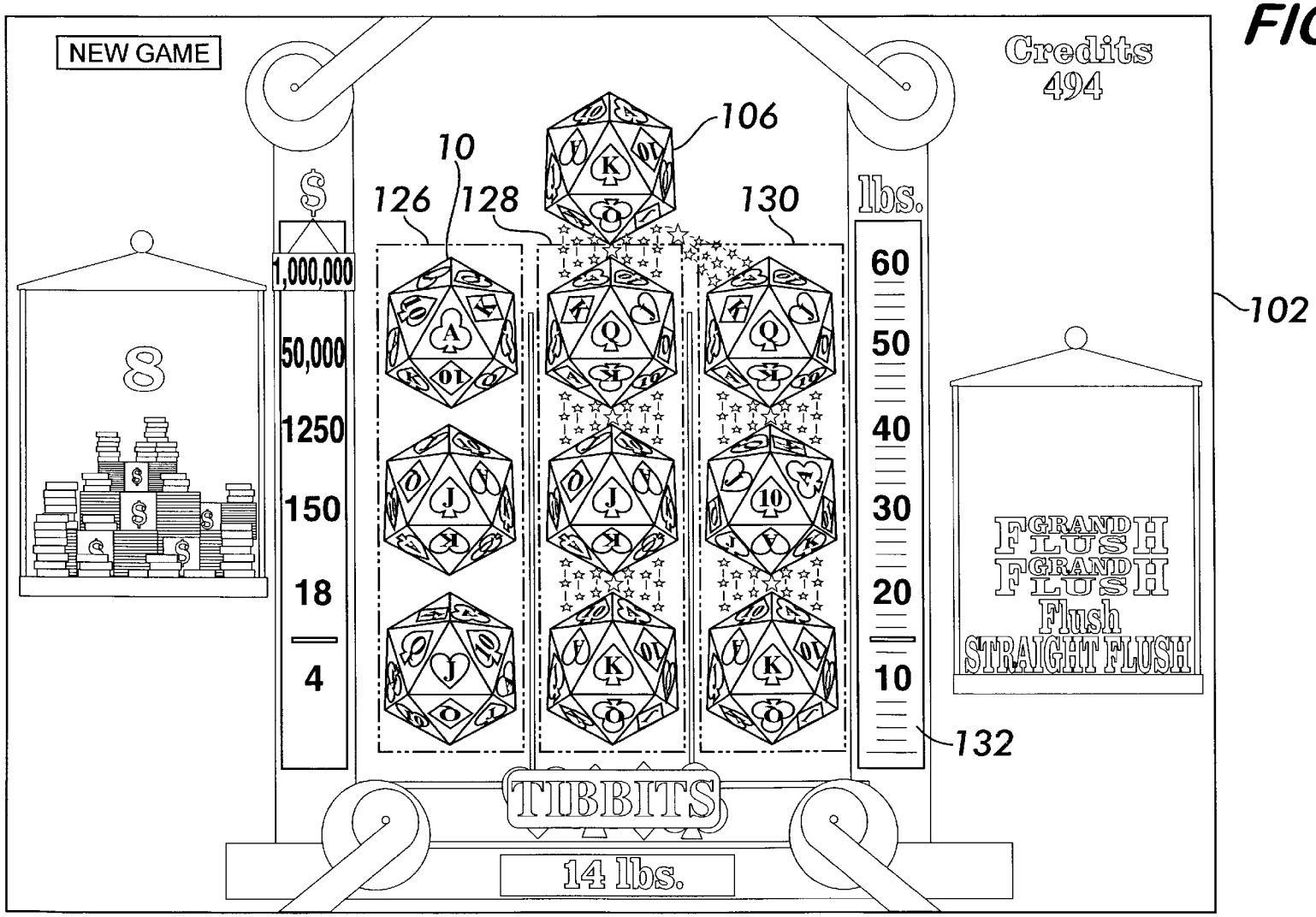
FIG. 7 is a schematic view of another version of the embodiment shown in FIG. 6 illustrating a video display.

A slightly different version of the embodiment shown in FIG. 6 which also uses the twenty-sided dice 10 is called TIP THE SCALE and is now illustrated with reference to FIG. 7. TIP THE SCALE also requires three credits to play. Although the playing screen is slightly different from that of FIG. 6, the playing screen for TIP THE SCALE similarly has three vertical columns 126, 128, 130 representing the individual playing sets. Each playing set holds three dice 10. As each die 10 appears in the top window 106 of the screen, the player chooses which of the playing sets will receive the die. The die falls to the bottom of the column or to the next available position. Any one column can hold no more than three die. After the first nine dice have been placed, a tenth or final die appears and remains above the nine in window 106.

Each winning combination has a weight value measured in pounds. As winning combinations are formed during play, the weight corresponding to each winning combination is added to the scale 132 on the right as seen is FIG. 7. As with the previous embodiment, the different three dice combinations are TIBSTER (all dice depicting the same exact face), straight flush, three-of-a-kind, flush, and loss. The different four dice combinations are Grand Tibster (all dice depicting the same exact face), grand straight flush, four-of-a-kind, grand flush and loss. The total weight accorded each hand is the sum of six point values associated with the six different combinations of dice—the three dice combination in each of the three large columns and the four dice combination of the dice in each column including the top (final) die. After the hand is completed, the total amount of weight on the scale determines the payout. One possible payout scale for the present embodiment is shown in Table 7.

TABLE 7

| 3-DICE COMBINATIONS | | COMBO VALUE (WEIGHT) | | 4-DICE COMBINATIONS | | COMBO VALUE (WEIGHT) | | | |
|---|---|---|---|---|---|---|---|---|---|
| Tibster | | 10 lbs. | | Grand Tibster | | 10 lbs. | | | |
| Straight Flush | | 8 lbs. | | Grand Straight Flush | | 8 lbs. | | | |
| Three-of-a-Kind | | 5 lbs. | | Grand Four-of-a-Kind | | 5 lbs. | | | |
| Flush | | 2 lbs. | | Grand Flush | | 2 lbs. | | | |
| Weight | Payout | Weight | Payout | Weight | Payout | Weight | Payout | Weight | Payout |
| 2 | .5 | 13 | 3.5 | 22 | 15 | 32 | 100 | 42 | 3000 |
| 4 | .5 | 14 | 4 | 23 | 19 | 33 | 160 | 44 | 6000 |
| 5 | .5 | 15 | 4.5 | 24 | 23 | 34 | 225 | 45 | 15000 |
| 6 | 1 | 16 | 5 | 25 | 28 | 35 | 295 | 46 | 15k |
| 7 | 1 | 17 | 5.5 | 26 | 34 | 36 | 370 | 48 | 20k |
| 8 | 1 | 18 | 6 | 27 | 40 | 37 | 450 | 50 | 25k |
| 9 | 1.5 | 19 | 7 | 28 | 48 | 38 | 530 | 52 | 100k |
| 10 | 2 | 20 | 9 | 29 | 57.5 | 40 | 625 | 56 | 250k |
| 11 | 2.5 | 21 | 12 | 30 | 66 | 41 | 1500 | 60 | 500k |
| 12 | 3 | | | | | | | | |

For example, a weight of 40 equates to a payout value of 625 credits for each unit of wager which here is three credits wagered (e.g., $625 for each $3 wagered where each credit is $1). FIG. 7 illustrates a video display with a full hand of symbols having four winning combinations in two columns 128, 130 to provide 14 lbs., for a payout of 8. The illustration of FIG. 7 is based on a payout scale for each weight twice that shown in Table 7, e.g., a weight of 20 has a payout of 2×9 or 18. This is believed to provide a negative return for the house.

This embodiment is not limited to twenty-sided dice having a 4×5 two-dimensional matrix of symbols or symbols selected with replacement. A twelve-sided die of multi-dimensional symbols, common six-sided die of one dimensional symbols, a generated deck of playing cards, or any other suitable type symbol format could be used to provide a set of possible symbols.

Other variations or modifications to the game will be apparent to those skilled in the art. Accordingly, the invention is not intended to be limited by the foregoing description, and changes and modifications may be incorporated and embodied in the scope of the appended claims.

What is claimed:

1. A method of playing a wagering game against a house, comprising the steps of:

(a) wagering an amount of credits;

(b) randomly selecting and displaying at least two symbols from a finite set of multi-dimensional symbols to form a hand, each of said symbols having at least two values, each of said values being from a distinct dimension, each said dimension comprising a set of at least two distinct values, all distinct values within each dimension being equally probable within said dimension, wherein each said symbol of said finite set is a unique equally probable combination of said distinct values from each of said dimensions, said finite set of multi-dimensional symbols being a complete set, and the selecting and displaying of each said symbol being done with replacement;

(c) making a payout, said payout being based on an assigned payout value for the combination of symbols in said hand chosen to provide the desired expectation of return for the house.

2. A method according to claim 1, further comprising the following steps after step (b), but before step (c):

(b)(i) choosing which of said displayed symbols of said hand to hold; and (b)(ii) upon the holding of fewer than all the displayed symbols in step (b)(i), randomly selecting and displaying new symbols from said finite set of multi-dimensional symbols to replace those symbols in said hand not held, said selecting and displaying of each new symbol being done with replacement.

3. A method according to claim 2, further comprising the step of repeating steps (b)(i) and (b)(ii) at least once prior to completing step (c).

4. A method in accordance with claim 2 wherein step b and step b(ii) each include a step of displaying the payout for the combination of symbols in said hand selected and displayed in the respective step.

5. A method according to claim 2 wherein one of said dimensions includes four distinct values and another of said dimensions includes three distinct values.

6. A method according to claim 5 wherein said four values include Spade, Heart, Club, and Diamond and said three values includes Ace, King, and Queen.

7. A method according to claim 2 wherein one of said dimensions includes four distinct values and another of said dimensions includes five distinct values.

8. A method according to claim 7 wherein said four values include Spade, Heart, Club, and Diamond and said five values include Ace, King, Queen, Jack and 10.

9. A method according to claim 2 wherein step (b) is carried out with multiple dice, each of said dice having faces showing said set of multi-dimensional symbols, each face consisting of one of said symbols.

10. A method according to claim 9 wherein said die has twenty faces, wherein one of said dimensions has four values and the other of said dimensions has five values.

11. A method according to claim 9 wherein said die consists of twelve faces, wherein one of said dimensions consists of three values and the other of said dimensions consists of four values.

12. A method according to claim 9 wherein step (b) is carried out by an electronic device having a video display for displaying a video representation of said die.

13. A method according to claim 9 wherein step (b) is carried out by rolling physical dice.

14. A method according to claim 2 wherein said assigned payout values are chosen to provide the house a positive expectation.

15. A method according to claim 1 wherein each of said symbols has at least three values.

16. A method according to claim 1 wherein step (b) is carried out by an electronic device having a video display for displaying said hand.

17. A method according to claim 1 wherein one of said dimensions includes four distinct values and another of said dimensions includes three distinct values.

18. A method according to claim 1 wherein one of said dimensions includes four distinct values and another of said dimensions includes five distinct values.

19. A method according to claim 1 wherein step (b) is carried out with multiple dice, each of said dice having faces showing said set of multi-dimensional symbols, each face consisting of one of said symbols.

20. A method according to claim 1 wherein step (b) is carried out by an electronic device having a video display for displaying playing cards.

21. A wagering game according to claim 1 wherein the payout values are predetermined to provide the house an expectation greater than zero over the long run.

22. A method of playing a wagering game against a house, comprising the steps of:

(a) wagering an amount of credits;

(b) randomly selecting and displaying at least two symbols from a finite set of multi-dimensional symbols to form a hand, each of said symbols having at least two values, each of said values being from a distinct dimension, each said dimension comprising a set of at least two distinct values, all distinct values within each dimension being equally probable within said dimension, wherein each said symbol of said finite set is a unique equally probable combination of said distinct values from each of said dimensions, said finite set of multi-dimensional symbols being a complete set, and the selecting and displaying of each said symbol being done with replacement;

(c) choosing which of said displayed symbols of said hand to hold;

(d) upon the holding of fewer than all the displayed symbols in step (c), randomly selecting and displaying new symbols from said finite set of multi-dimensional symbols to replace those symbols in said hand not held, said selecting and displaying of each new symbol being done with replacement;

(e) making a payout, said payout being based on an assigned payout value for the combination of symbols in said hand, wherein all possible combinations of symbols from said finite set have been assigned payout values which provide a positive expectation of return for the house.

23. A method in accordance with claim 22 further comprising the step of:

upon the selection and display of new symbols in step d, repeating steps (c) and (d) at least once after step (d).

24. A method according to claim 23 wherein steps (b), (d), and (e) are carried out by an electronic device.

25. A wagering game according to claim 22 wherein the payout values are predetermined to provide the house an expectation greater than zero over the long run.

26. A method of playing a game against a house, comprising the steps of:

(a) wagering an amount of credits on a desired combination of symbols predetermined to have a payout value;

(b) randomly selecting and displaying at least two symbols from a finite set of multi-dimensional symbols, each of said symbols having at least two values, each of said values being from a distinct dimension, each said dimension comprising a set of at least two distinct values, all distinct values within each dimension being equally probable within said dimension, wherein each said symbol of said finite set is a unique equally probable combination of said distinct values from each of said dimensions, said finite set of multi-dimensional symbols being a complete set, and the selecting and displaying of each said symbol being done with replacement;

(c) upon the selection and display of the combination of symbols wagered upon in step (a), making a payout, said payout being based on the predetermined payout value for the combination of symbols in said hand which is predetermined to provide the desired expectation of return for the house.

27. A method in accordance with claim 26 wherein step (b) is carried out with multiple dice, each of said dice having faces showing said set of multi-dimensional symbols, each of said faces having one of said symbols.

28. A method in accordance with claim 27 wherein each of said dice have twelve faces.

29. A method in accordance with claim 27 wherein each of said dice have twenty faces.

30. A method in accordance with claim 26 further comprising:

(b)(i) upon the selection in step (b) of the desired combination wagered on in step (a), repeating step (b); and wherein the payout in step (c) is further based on the number of times in a row the desired combination wagered upon in step (a) is selected.

* * * * *